US006581799B1

(12) United States Patent
Garrant et al.

(10) Patent No.: US 6,581,799 B1
(45) Date of Patent: Jun. 24, 2003

(54) PRODUCT DISPENSER

(75) Inventors: Steven S. Garrant, Greenwich, NY (US); Jonathan W. Hedman, Burnt Hills, NY (US); Mark A. Ferguson, Syracuse, NY (US); Jeffrey P. Pirro, Marcellus, NY (US); David A. Furth, Skaneateles, NY (US); Richard H. Chapman, Camillus, NY (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 09/658,201

(22) Filed: Sep. 8, 2000

(51) Int. Cl.[7] ..... G07F 11/00
(52) U.S. Cl. ..... 221/88; 221/268
(58) Field of Search ..... 221/79, 87, 88, 221/82, 76, 2, 7, 13, 115, 105, 268, 232, 231, 272; 206/701, 703, 704

(56) References Cited

U.S. PATENT DOCUMENTS

| | | | | |
|---|---|---|---|---|
| 3,394,796 A | | 7/1968 | Jensen | 206/42 |
| 3,437,236 A | | 4/1969 | Huck | 221/86 |
| 3,633,792 A | | 1/1972 | Steigerwald | 221/267 |
| 3,897,265 A | | 7/1975 | Jaggard | 136/86 A |
| 3,995,767 A | | 12/1976 | Brindley et al. | 221/82 |
| 4,015,708 A | | 4/1977 | Kelm | 206/333 |
| 4,124,143 A | * | 11/1978 | Thomas | 221/82 |
| 4,209,091 A | | 6/1980 | Lieberman | 206/333 |
| 4,591,539 A | | 5/1986 | Oltman et al. | 429/27 |
| 4,649,090 A | | 3/1987 | Oltman et al. | 429/29 |
| 4,696,402 A | | 9/1987 | Harmon et al. | 206/602 |
| 4,791,034 A | | 12/1988 | Dopp | 429/27 |
| 4,860,890 A | | 8/1989 | Cerny et al. | 206/333 |
| 4,953,700 A | | 9/1990 | DeDino | 206/333 |
| 5,033,616 A | | 7/1991 | Wyser | 206/333 |
| 5,117,977 A | | 6/1992 | Voroba | 206/333 |
| 5,129,546 A | | 7/1992 | Thielmann | 221/66 |
| 5,199,565 A | | 4/1993 | Voroba | 206/333 |
| 5,203,455 A | | 4/1993 | Hewelt et al. | 206/333 |
| 5,308,711 A | | 5/1994 | Passaniti et al. | 429/29 |
| 5,404,105 A | | 4/1995 | Chari | 324/426 |
| 5,477,981 A | | 12/1995 | Heyl | 221/86 |
| 5,647,507 A | | 7/1997 | Kasper | 221/151 |
| 5,795,667 A | | 8/1998 | McKenzie et al. | 429/27 |
| 5,804,327 A | | 9/1998 | Oltman | 429/27 |
| 5,839,583 A | | 11/1998 | Pope et al. | 206/704 |
| 6,039,185 A | | 3/2000 | Pedracine et al. | 206/704 |
| 6,164,490 A | | 12/2000 | Bishop et al. | 221/197 |

FOREIGN PATENT DOCUMENTS

| | | | |
|---|---|---|---|
| GB | 2071618 | 11/1983 | B65D/83/04 |

* cited by examiner

*Primary Examiner*—Kenneth W. Noland
(74) *Attorney, Agent, or Firm*—Linda Gebauer

(57) ABSTRACT

A product dispenser comprising a cover, a slidable push element, a base and a landing is provided. The cover and the base are rotatable with respect to each other about a common axis. The cover comprises a roof opening in which the push element slides in opposing directions, advancing product from the interior of the cover onto the landing. In a preferred embodiment, the dispenser houses miniature zinc air batteries, secured to the base using an adhesive platform. When a cell is advanced from the interior of the cover onto the landing, the cell is separated from the adhesive platform, allowing air to pass into the cell and the cell to be activated. The landing preferably comprises a magnet for releasably securing product. The dispenser is then used as an inserter for orienting and placing the product in position in a device. The product is not directly handled during its removal from the dispenser or during its insertion into a device. In the case of a zinc air cell, the cell is untabbed without any direct handling of tab material by the user, and the material functioning as a tab stays with the dispenser upon separation from the cell.

31 Claims, 9 Drawing Sheets

PRODUCT DISPENSER

BACKGROUND OF THE INVENTION

The present invention relates to a dispenser for housing and dispensing product, such as miniature batteries including zinc air cells used in hearing aids. As used herein, "battery" means one or more cells.

Handling of miniature batteries is difficult because of their small size. Handling of miniature batteries is typically required in order to remove the batteries from their packaging, to insert the batteries in the proper orientation into a device, and, in the case of air cells, to remove any individual tabbing associated with the cell prior to use. Tabbing is normally associated with metal air cells such as zinc air cells, to limit the ingress of oxygen into the cell until such time as the cell is placed into service. The tab also functions to limit the transport of water vapor in or out of the cell and limits the ingress of carbon dioxide into the cell. Typically, the tab comprises an adhesive material covering one or more air ports. Upon removal of the tab, the ports are exposed to the oxygen of the ambient environment, thereby enabling the cell to be activated. The challenge of handling miniature batteries is exacerbated in the event the user suffers from reduced dexterity, poor vision or other physical infirmity.

Efforts to address some of these issues are found in the art. For example, U.S. Pat. No. 6,039,185 discloses a device for inserting a hearing aid battery into a hearing aid. The device comprises so-called "petals" with an air cell residing on each petal. The cells are individually tabbed, and each tab is then adhered to the petal. The cell is inserted into the hearing aid by gripping the inserter and bringing the appropriate petal up close to the hearing aid battery door to enable the cell to be engaged within the door. The cell is then separated from the inserter using a wiping motion, purportedly leaving the tab adhered to the petal. The method of separating the cell from its associated tab and the inserter as disclosed in the '185 patent places stresses on the hearing aid device, presenting the potential for damage to the device.

Typical packaging for miniature zinc air cells presents further problems. Common packaging for miniature zinc air cells is disclosed for example in U.S. Pat. No. 4,593,700. The packaging disclosed therein consists of a thermoformed or molded blister rotatably attached to a paperboard card. The blister comprises multiple compartments each containing a battery. A battery is dispensed from the package by rotating the blister to align a loaded compartment with a trap door accessible in the back of the card. The trap door can come open during transport and batteries will fall out. The trap door becomes weak and ineffective after multiple uses. The base of the dial can also separate or pull away from the card allowing batteries to fall out. Finally, the consumer must still handle the battery to remove the tab, properly orient the cell in connection with the device terminals and insert the cell into the device once the battery has been removed from the package.

Some consumers use a separate tool to assist them in loading miniature batteries into devices. This tool consists of a magnet on the end of a wand. The tool can be easily misplaced and provides little aid in removing the individual tabbing associated with common zinc air cells.

Handling of other small products including but not limited to pharmaceuticals such as pills, foodstuff such as candy, hardware such as screws, and the like can be equally difficult because of their size, particularly for those users suffering from reduced dexterity, poor vision or other physical infirmity. While the within invention is illustrated in connection with miniature cells, and in particular in connection with miniature zinc air cells, it will be appreciated that the within invention can also be utilized in connection with the transport, storage and dispensing of such other small products. As used herein, the term "product" is not limited to miniature cells or batteries, and fully comprehends such other small products as those identified above.

It is therefore a first object of the present invention to provide a product dispenser that acts as both a structural package for housing and transporting product and a dispenser for removing product from the package and an inserter for manipulating and orienting product into a device or other end use location.

It is also an object of the present invention to provide a product dispenser that removes any direct handling of product prior to its insertion into a device or other end use location.

It is a further object of the present invention to provide a product dispenser that obviates the need for direct handling of tab material in the case of a metal air cell such as a zinc air cell.

It is a further object of the present invention to provide a product dispenser that both activates and dispenses air cells such that the user does not have to handle the cells either before or after insertion into a device.

Another object of the present invention is to provide a product dispenser that eliminates the need for additional tools to handle and orient product for insertion or placement for end use.

Another object of the present invention is to provide a product dispenser that avoids unintended dispensing from the dispenser.

Another object of the present invention is to provide a refill base cartridge for a product dispenser.

Another object of the present invention is to provide a product dispenser that optionally allows the user to attach a refill base after removal of a spent base cartridge.

Another object of the present invention is to provide a product dispenser that allows the consumer to store used product for disposal or material recovery purposes.

The foregoing and additional objects of this invention will become fully apparent from the following description and the accompanying drawings.

SUMMARY OF THE INVENTION

The present invention provides for a product dispenser that is easy to use for storing and dispensing product, such as miniature batteries. The dispenser of the within invention obviates the need to handle the product at any point during the dispensing process or during the insertion or placement process of the product for its end use. To achieve this and other advantages, and in accordance with the purposes of the present invention as embodied and described herein, the present invention provides for a product dispenser comprising a cover and a base, each rotatable with respect to the other about a common axis, a retractable push element slidably engaged along an opening in the roof of the cover, and a landing. The cover further comprises a wall and a wall opening. The roof opening, wall opening and landing are aligned to enable product to be advanced from the interior of the cover, through the wall opening and onto the landing by the push element. The landing is designed to accept and removably retain individual product. The push element slides in opposing directions along the roof opening to engage product and advance product from the interior of the cover onto the landing. The base cooperates with the cover assembly to house the product and provides locations for securing product prior to dispensing.

In another embodiment, the cover further comprises a rib. The rib is secured to the inner surface of the roof such that when the cover is assembled with the base, the product is under pressure from the rib allowing the rib to further secure the product to the base during transport and storage. In another embodiment, the rib functions to apply pressure so as to seal an air cell to a gasket prior to dispensing.

In another embodiment, the cover is removably attached to the base allowing the base to be disposed of and a replacement base with additional product to be joined with the cover.

In another embodiment the bottom side of the base comprises a storage area for storing used product for disposal or material recovery purposes. The entire dispenser could be processed for material recovery or otherwise recycled. In the event the cover and the base are separable, the base alone could be processed for material recovery or otherwise recycled.

In another embodiment the cover is made of see-through material and the push element or base or both can be color coded to indicate various product characteristics, such as size.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

The specific embodiments illustrated in the appended drawings and described in the following specification are simply exemplary embodiments of the inventive concept defined in the appended claims. Hence, specific dimensions and physical characteristics relating to specific embodiments disclosed herein are not to be considered as limiting, unless the claims expressly state otherwise.

The dispenser 10 of the within invention comprises a cover 12, a retractable push element 14, and a base 16. The cover 12 and the base 16 are connected such that each can be rotated about a common axis with respect to the other. That is, the cover can be rotated while maintaining the base in a stationary position, or, conversely, the base can be rotated while maintaining the cover in a stationary position.

Figure 1:
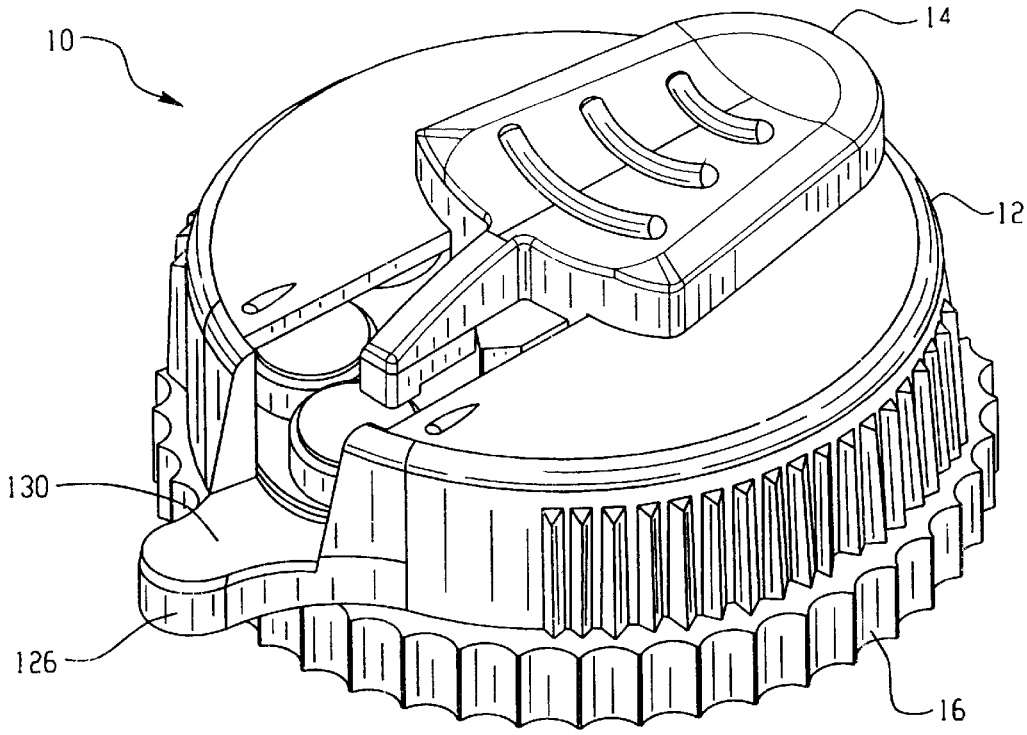
FIG. 1 is a view of a product dispenser according to the within invention.
Figure 2A:
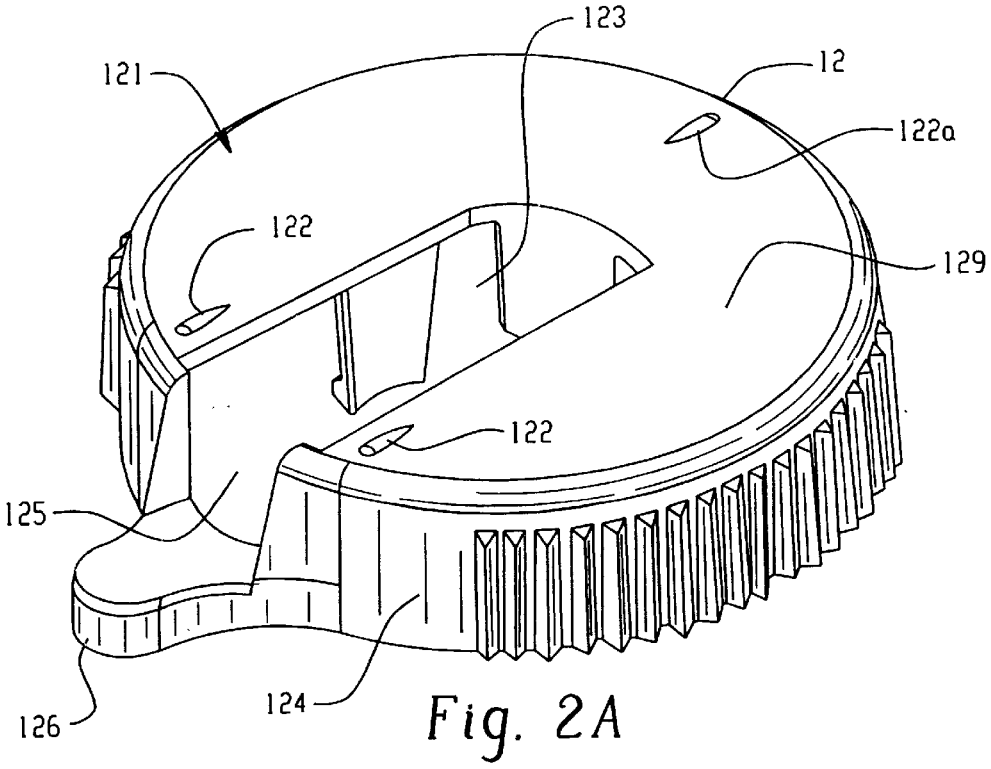
FIG. 2A is a view of a cover of a product dispenser according to the within invention.
Figure 2B:
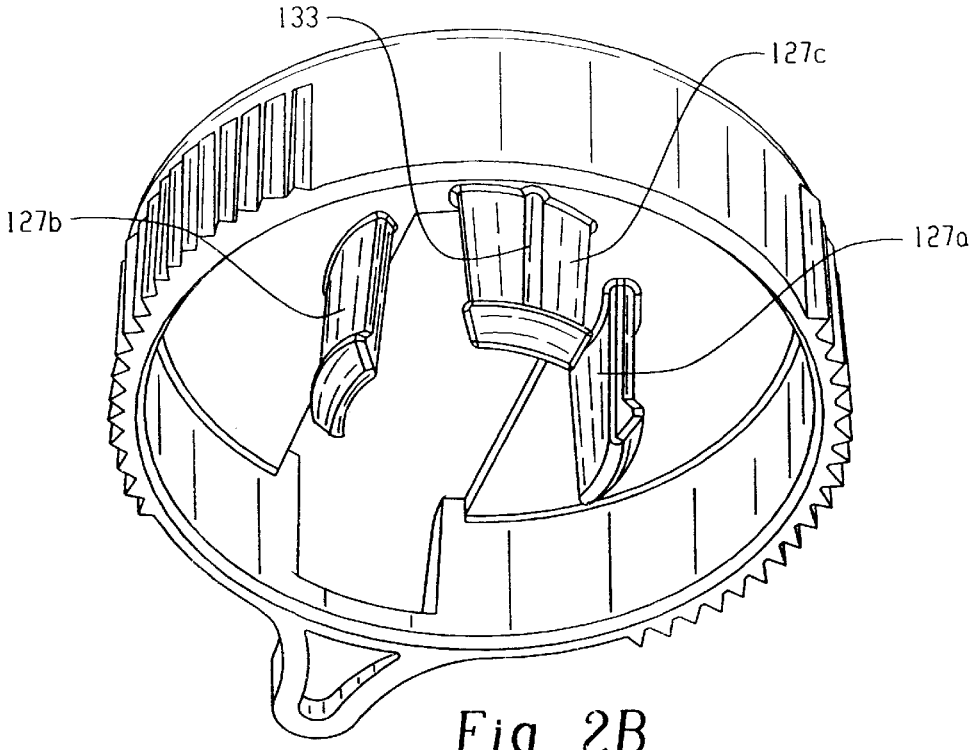
FIG. 2B is another view of the cover of FIG. 2A.
Figure 2C:
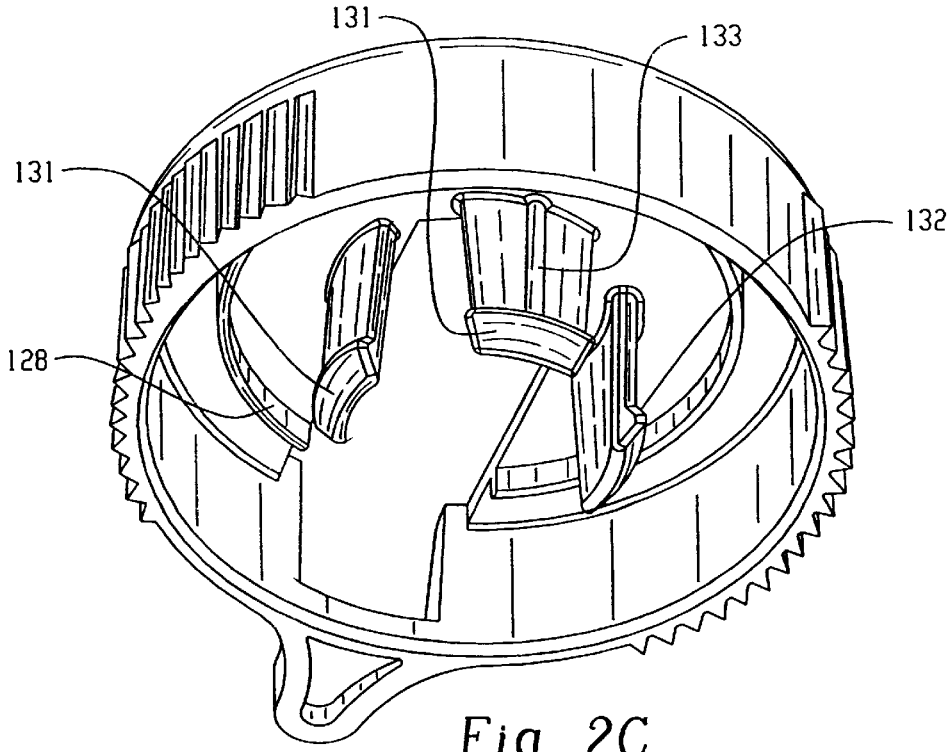
FIG. 2C is a view of an alternate cover of a product dispenser according to the within invention.
Figure 3A:
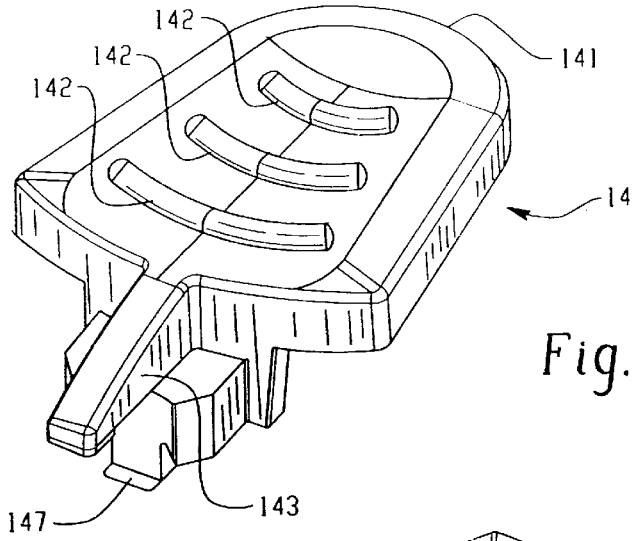
FIG. 3A is a view of a push element of a product dispenser according to the within invention.
Figure 3B:
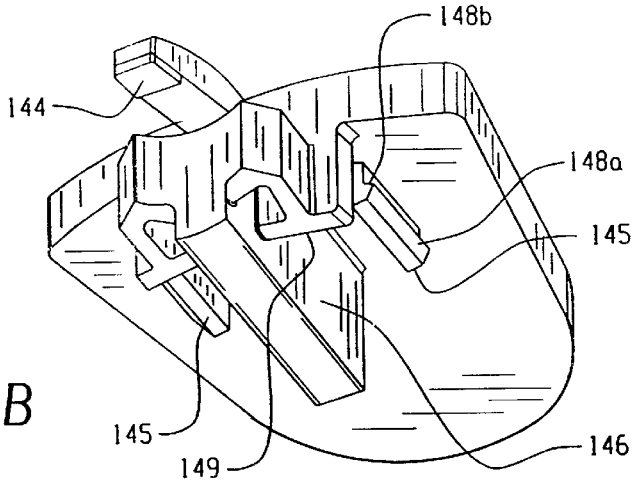
FIG. 3B is another view of the push element of FIG. 3A.
Figure 3C:
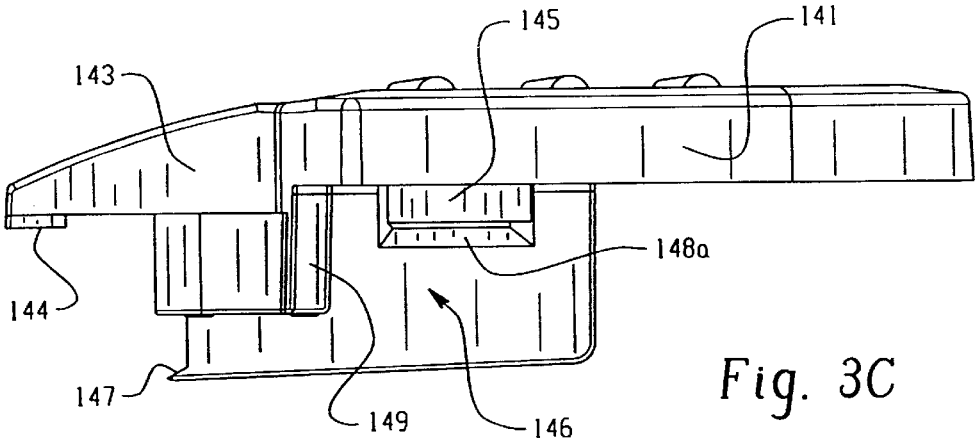
FIG. 3C is a side view of the push element of FIGS. 3A and 3B.

The rotatable cover 12 comprises a roof 121, roof ramps 122, a roof opening 123, a wall 124, a wall opening 125, a landing 126, and flexible snap-hook connectors 127*a*, 127*b* and 127*c*. In a preferred embodiment, the cover 12 is made from a readily-available, polycarbonate-based material such as Lexan® 143R resin manufactured by GE Plastics and available from Polymerland Service Center, Pittsburgh, Pa. 15264. It should be appreciated that other durable materials may be used in producing the cover 12. In addition, the cover 12 may further include a rib 128 as shown in FIG. 2C.

The roof ramps 122 protrude from the outer surface 129 of the roof 121 adjacent to the roof opening 123. The roof ramps 122 are angled protrusions that frictionally engage the push element 14 and create a transitional stopping action for the push element as it is extended. The ramps 122 aid in providing a fluid and controlled motion for the push element 14 that encourages controlled movement of product toward the landing 126. The ramps 122 also aid in maintaining the push element in a fully extended position. Alternatively, a third roof ramp 122*a* may be positioned on the outer surface 129 of the roof 121 such that the third roof ramp aids in keeping the push element in place while fully retracted. It will be appreciated that a wide variety of shapes and locations can be utilized for the roof ramps without departing from the teachings of the within invention.

The roof opening 123 is coincidental with the wall opening 125 and the landing 126 is secured to the cover 12 at a location adjacent to the wall opening 125. Product passes through the wall opening 125 from the interior of the cover 12 onto the landing 126. Product aligned at the wall opening 125 for such transition is said to be located in the product dispensing position.

Figure 4A:
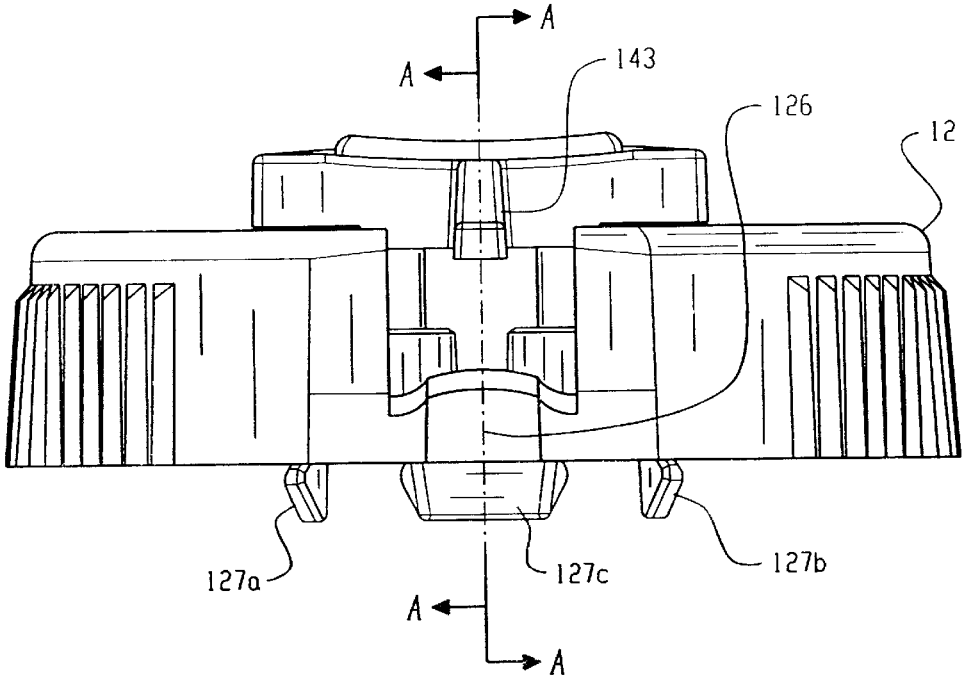
FIG. 4A is a front view of a cover and push element of a product dispenser according to the within invention.
Figure 4B:
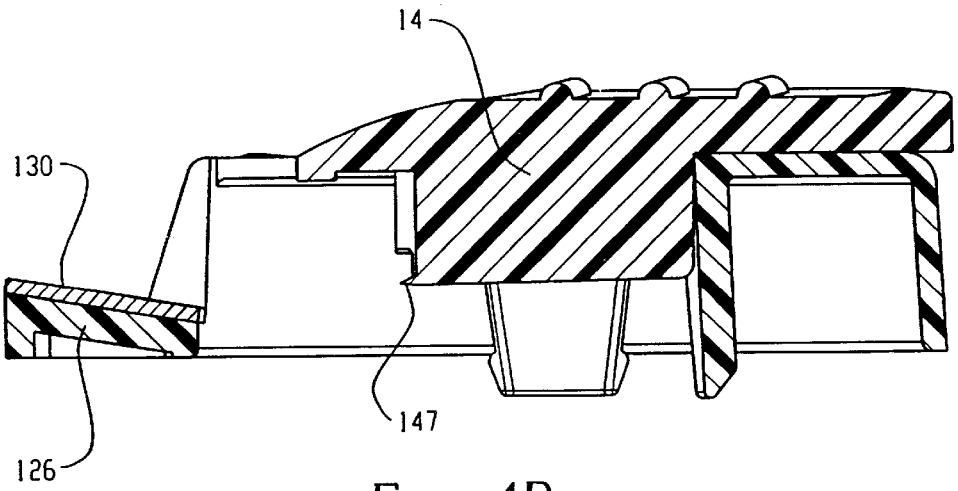
FIG. 4B is a section view of the cover and push element of FIG. 4A.
Figure 5A:
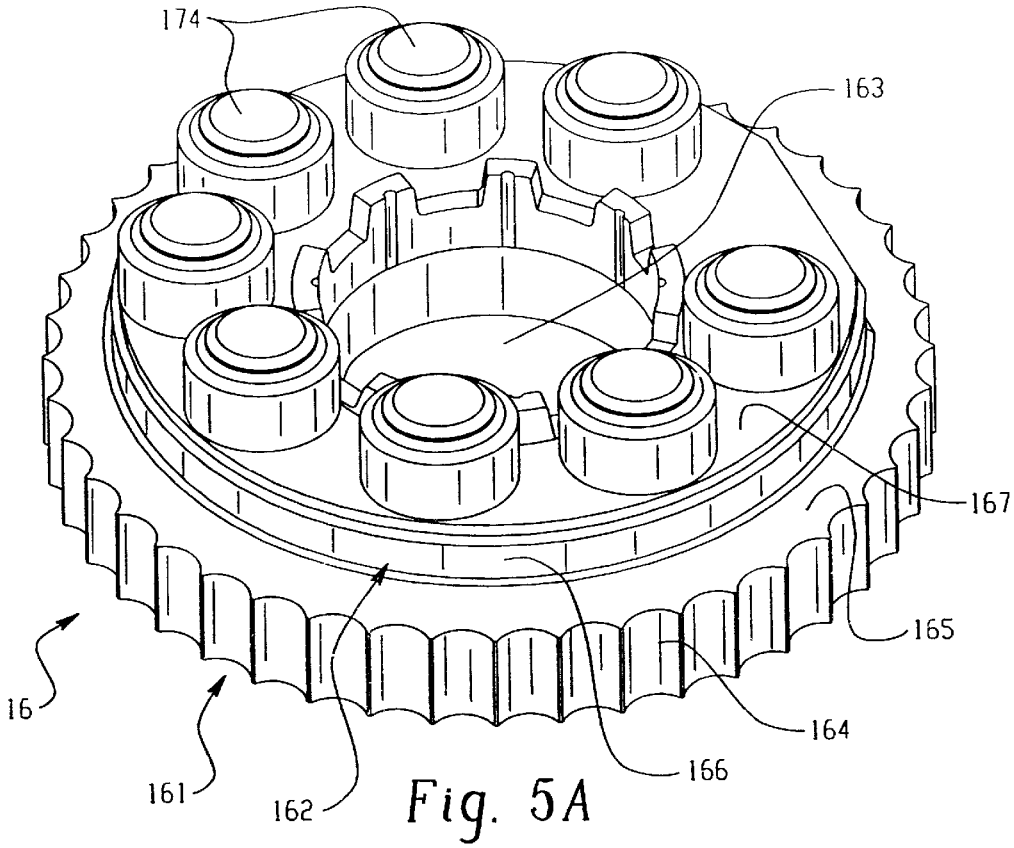
FIG. 5A is a view of a base of a product dispenser according to the within invention.
Figure 5B:
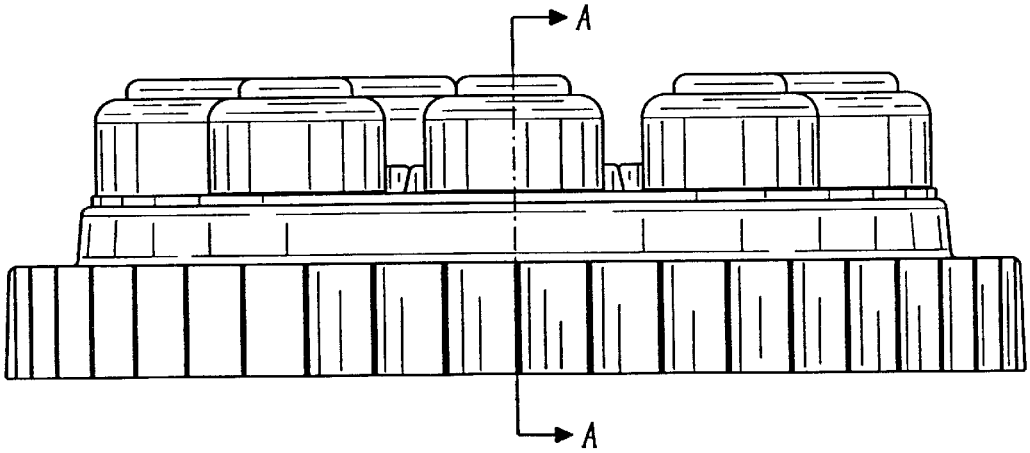
FIG. 5B is a side view of the base of FIG. 5A.
Figure 5C:
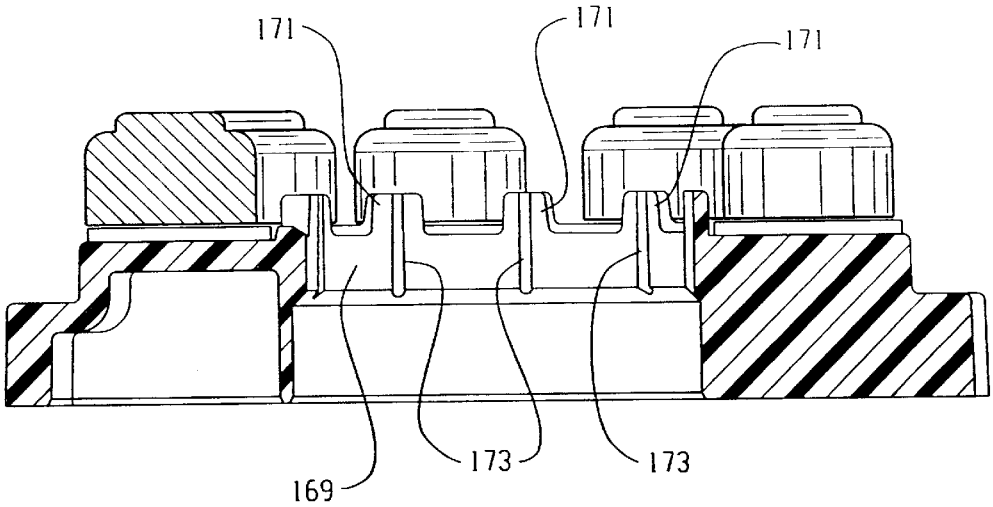
FIG. 5C is a section view of the base of FIG. 5B.
Figure 5D:
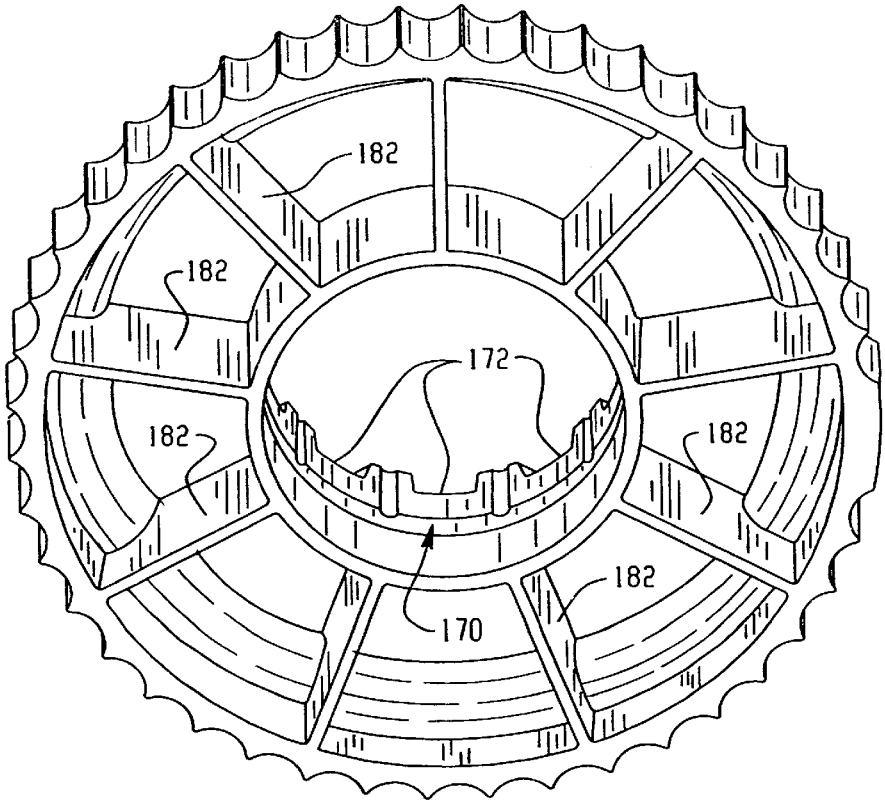
FIG. 5D is another view of the base of FIG. 5A.
Figure 6A:
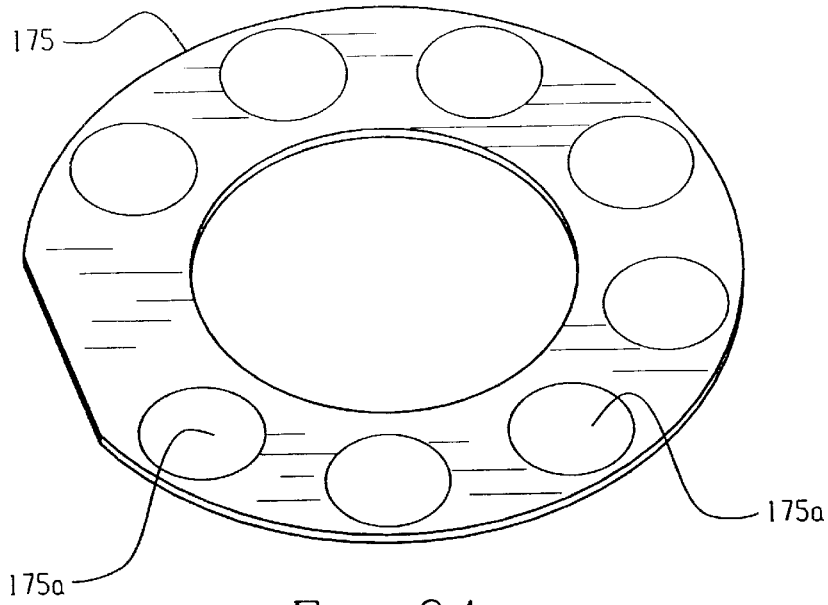
FIG. 6A is a view of a platform of a product dispenser according to the within invention.
Figure 6B:
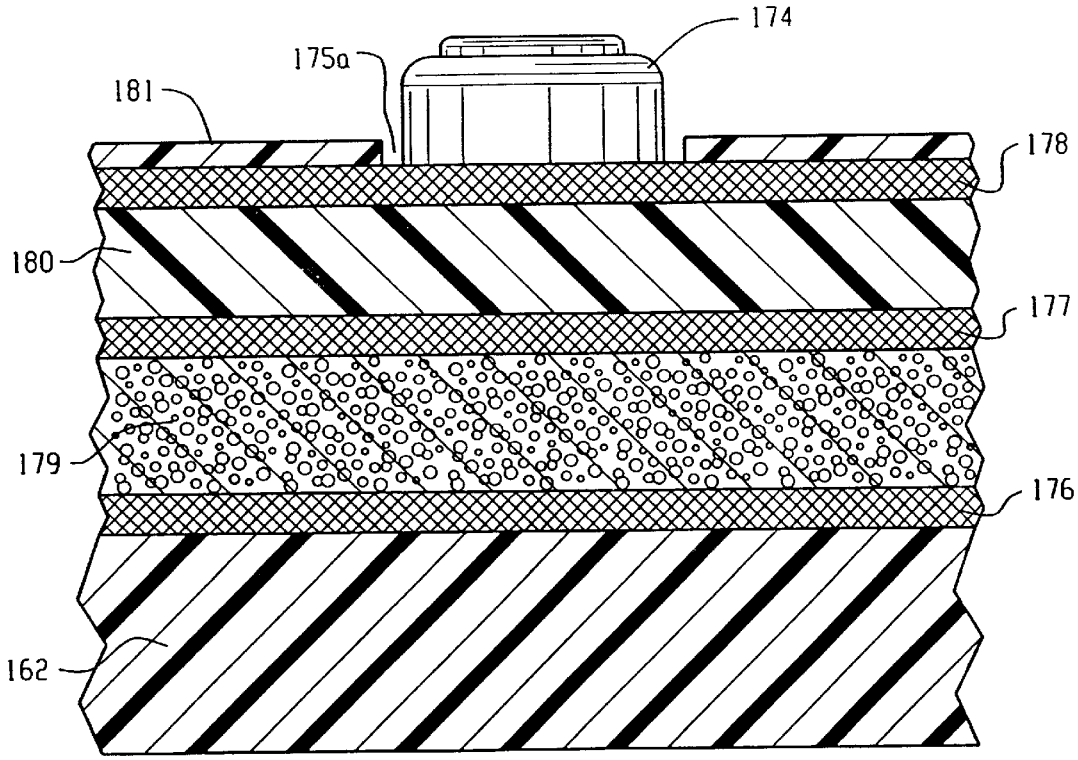
FIG. 6B is a side view of a platform of a product dispenser according to the within invention.

The landing 126 is preferably inclined as shown in FIG. 4B to further aid in transitioning the product from the interior of the cover 12 to the landing 126. The landing 126 optionally comprises a magnetic component 130 secured to the landing 126 via a pressure sensitive adhesive. The magnetic component 130 aids in controlling and removably maintaining metallic products such as miniature batteries on the landing 126. Alternatively, as dictated by the product, other surfaces or materials, such as velcro or adhesives, may be utilized for controlling and removably maintaining products on the landing 126 as will be appreciated by those skilled in the art. These alternate surfaces or materials may comprise the entire landing 126 or may be secured to the landing 126 via an adhesive or other securing method. Further, the magnetic component 130 can be planar or otherwise shaped, and may be exposed or embedded within the landing. Where product use and placement permit, the landing 126 may further include a stop wall (not shown) at its distal end to further control the forward motion of the product as it transitions from the interior of the cover 12 to the landing 126. It should be appreciated that the landing 126 may be integral to the cover 12 or the base 16 or may be a separate component connected to either the cover 12 or the base 16.

The snap hook connectors 127*a*, 127*b* and 127*c* extend from the inner surface of the roof 121 and are positioned at 90 degree intervals around the roof opening 123. The connectors further comprise flexible angled lead-in surfaces 131 and flexible tension-providing surfaces 132. The lead-in surfaces 131 interact with the inner surface of the base opening during connection of the base with the cover, causing the snap hook connectors to flex inwardly, as will be more fully explained below. The tension-providing surfaces 132 maintain tension contact with the base upon completion of the connection process and the outward return flex of the snap hook connectors 127*a*, 127*b* and 127*c*. The number and positioning of the snap hook connectors is a matter of design choice and can be varied without departing from the scope of the within invention.

One of the snap hook connectors further comprises a rib 133. The rib 133 is positioned such that when the cover 12 or the base 16 is rotated, a stop point is created once the rib 133 engages a base turret groove 173. Each such stop point aligns a product and/or a product dispensing position with the wall opening 125 of the cover 12.

The outer surface of the cover wall 124 may be all or partially ribbed as illustrated or otherwise textured to provide a grip for the cover 12 during relative motion between the cover 12 and base 16. Additional gripping can be provided by extending the upper surface of the cover 12 outwardly beyond the cover wall 124 at one or more locations.

The push element 14 comprises a thumbpiece 141 having gripping ribs 142 or alternatively a textured surface secured to the upper surface of the thumbpiece 141 for gripping the push element 14. In a preferred embodiment, the push element is molded from a polystyrene material such as Styron 6075 manufactured by Dow Plastics and available from General Polymers, Columbus, Ohio 43216.

The push element 14 further comprises a projection 143. The projection 143 extends over at least a portion of the product located in the product dispensing position during transport and storage of the dispenser 10, to aid in maintaining the product in this position. The projection 143 further aids in controlling the movement of product during transition from the interior of the cover 12 onto the landing 126, and in maintaining the position of individual product on the landing 126. Optionally, a lip 144 is located on the bottom surface of the projection 143 which aids in securing individual product in the product dispensing position and in position on the landing 126.

The push element 14 further comprises two slide rails 145 and a center rudder 146, both secured to the lower surface of the thumbpiece 141. The rudder 146 is aligned with a base turret opening 172 whenever the snap hook connector rib 133 is engaged with a base turret groove 173 to create a stop position for relative motion between the cover 12 and the base 16. Such alignment is required to allow the push element to be extended. When the push element 14 is fully retracted, the rudder 146 does not occupy the aligned base turret opening 172 and the base 16 and the cover 12 are free to move with respect to each other between stop positions. This fully retracted position will be referred to herein as the first position of the push element 14. At a stop position the push element 14 can be partially or fully extended, causing the rudder 146 to occupy the aligned base turret opening 172 thereby preventing motion between the base 16 and the cover 12 to an alternate stop position. This partial or full extension position will be referred to herein as the second position of the push element 14.

The rudder 146 further comprises a scraper 147 positioned at the front of the rudder. The scraper 147 is designed to separate individual product from the product dispensing position by interposing the scraper 147 between the product and the product dispensing position upon extension of the thumbpiece 141. In the case of an air cell, interposing the scraper 147 between the cell and the product dispensing position untabs the cell, allowing air ingress and cell activation.

It should be appreciated that the projection 143, the lip 144 and the scraper 147 may all be contoured to shape according to the product contained within the dispenser without departing from the teachings herein.

The slide rails 145 of the thumbpiece 141 comprise snap hooks having angled surfaces 148*a* and flat surfaces 148*b*. The angled surfaces 148*a* allow a portion of the push element 14 to pass through the roof opening 123 for snap connection of the push element with the cover 12. The angled surfaces 148*a* contact the sides of the roof opening during connection causing the snap hooks to flex inwardly. Once the angled surfaces 148*a* have cleared the roof opening 123, the snap hooks retract, thereby engaging the inner surface of the cover and the flat surfaces 148*b* of the snap hooks, enabling the push element to slidably extend and retract along the roof opening 123.

The push element 14 further comprises two stop walls 149 positioned on the lower surface of the thumbpiece 141. The stop walls 149 define a stop position for the fully extended push element 14 upon contacting the inside surface of the cover wall 124. In an alternative embodiment, the stop position for the fully extended push element 14 can be provided by extending the slide rails 145 so that they contact the inside surface of the cover wall 124 when the push element 14 is fully extended.

The base 16 comprises a lower tier 161, an upper tier 162 and a hollow center 163. The lower tier comprises an outer wall 164 and an upper surface 165. The upper tier further comprises an outer wall 166 and an upper surface 167. In a preferred embodiment, the base is molded from Styron 6075 as described above.

The lower tier upper surface 165 is sized to accommodate the width of the cover wall 124. When joined, the bottom surface of the cover wall 124 is in contact with the lower tier upper surface 165 and a portion of the inner surface of the cover wall 124 is in contact with the upper tier outer wall 166.

All or a portion of the lower tier outer wall 164 may be partially ribbed as shown or otherwise textured to provide a grip for the base 16 during relative motion between the cover 12 and base 16. Extensions (not shown) from the base may be included to provide handles to aid in separating the base 16 from the cover 12. The lower tier outer wall 164 may optionally include an indicator such as an arrow (not shown). Aligning the landing 126 with the indicator during connection of the cover and base also aligns the snap hook connector rib 133 of the cover 12 with a base turret groove 173, facilitating the connection.

The hollow center 163 further comprises a turret partition 169 defined by a beveled edge 170 and turret structures 171 extending above the upper tier upper surface 167. The turret structures 171 are separated by turret openings 172. The openings 172 are sized to permit the rudder 146 to occupy an opening during extension of the push element 14 in its second position. The lead in surfaces 131 of the cover snap hook connectors 127*a–c* contact the turret partition 169 during connection of the cover and base, causing the cover snap hook connectors to flex inwardly. Upon encountering the beveled edge 170 of the base hollow center 163, the snap hook connectors retract, allowing the tension-providing surfaces 132 of the cover snap hook connectors to contact the beveled edge and thereby secure the cover and base together.

The turrets 171 further comprise grooves 173 extending along the length of the partition 169. Insertion of the snap hook rib 133 of the cover into one of the turret grooves 173 defines a stop position whereby product located at the product dispensing position is aligned with the cover wall opening 125 and the landing 126.

Product is affixed to the upper tier upper surface 167 via adhesive or other suitable means. In a preferred embodiment of the within invention, zinc air miniature cells 174 are exemplified as the product, and are adhered to the base using an adhesive platform 175. The platform comprises at least one adhesive layer. In a preferred embodiment, the platform comprises a lower adhesive layer 176, a mid adhesive layer 177, an upper adhesive layer 178, a foam tape layer 179 sandwiched between the lower and mid adhesive layers, a mylar film layer 180 sandwiched between the mid and upper adhesive layers, and a polyester overcoat layer 181 located atop the upper adhesive layer. The lower and mid adhesive layers with a foam layer sandwiched in between are available as a single product, from Label Technologies Inc., Spec. #4105 (double sided closed cell foam with acrylic adhesive), Suwanee, Ga. The mylar film layer and upper adhesive layer are also available as a single product from Label Technologies Inc., Spec. #72907 (polyolefin with R-143 adhesive). The polyester overcoat layer is available from Label Technologies Inc., Spec. #2216 (interfilm metalized polyester). Alternating cutouts 175*a* are provided in the overcoat layer 181 to expose portions of the underlying adhesive layer 178. The air cells 174 are placed upon the exposed adhesive portions to seal their associated air ports until such time as the cell is transferred from the interior of the cover to the landing. In a preferred embodiment, the cutouts are larger than the diameter of the cells, such that the cells do not come into direct contact with the overcoat layer. It will be appreciated that the overcoat layer 181 is an optional feature designed primarily to prevent the accumulation of dust and other debris on the upper adhesive layer 178 and to provide an aesthetically pleasing appearance. As such, it will be appreciated that other materials with an aesthetically appealing appearance, adequate adhesion to the underlying adhesive layer, and a surface that will avoid the accumulation of dust and debris could be used in place of the polyester overcoat layer 181.

In this embodiment, the air cells are not individually tabbed, thereby obviating the expense associated with such an operation. Further, the tabbing material remains with the dispenser when the cell is dispensed, avoiding the need to handle or otherwise dispose of an individual tab. It will be appreciated, however, that the dispenser of the within invention can be utilized with individually tabbed air cells. In such an embodiment, the tab is mechanically or adhesively joined to the base. The cell is then separated from the tab when the thumbpiece scraper is inserted between the tab and the cell. The cell is then advanced from the interior of the cover onto the landing while the tab remains attached to the dispenser base.

Individual tabbing of air cells can also be avoided using the within invention where one surface of a gasket sealing material is affixed with an appropriate adhesive to the upper tier surface 165 of the base. The opposing gasket surface then directly contacts the bottom of the cell. The cells are then sealed by placing sufficient downward pressure on the top of the cell from the cover rib 128 to effectively limit the amount of air ingress until such time as the cell is advanced to the product dispensing position. The pressure also secures the cells in position on the base until dispensed.

Other techniques and methods for adhering product to the base may also be used without departing from the teachings of the within invention. Adhesive to secure product may be applied as a surface coating to the upper tier upper surface 165, or alternatively, may be applied in discrete locations to coincide with the number and spacing of product on the upper surface of the upper tier. Adhesives appropriate to the type of product can be selected as is known in the art.

Figure 7B:
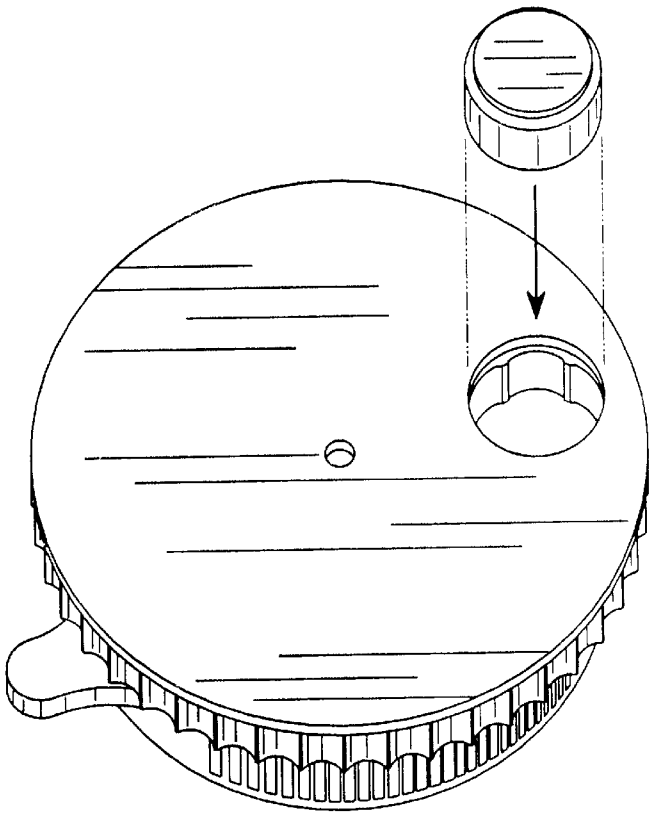
FIGS. 7A, 7B and 7C illustrate an alternate base of a product dispenser according to the within invention.
Figure 7A:
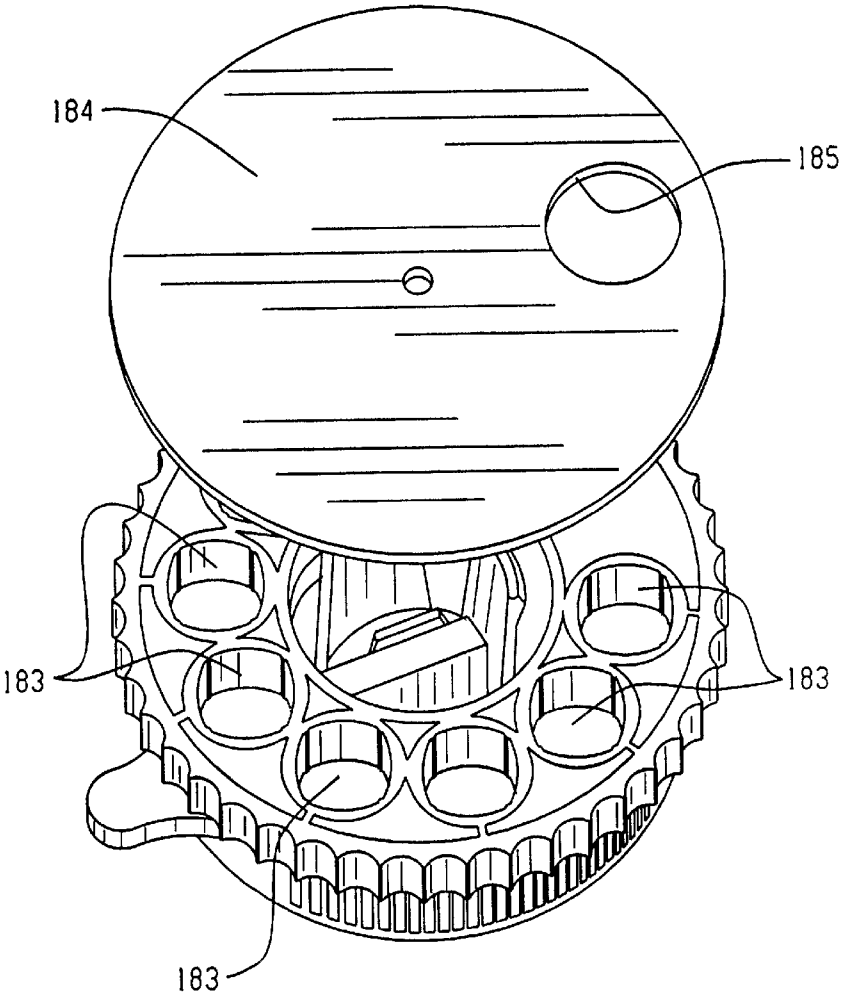
Figure 8:
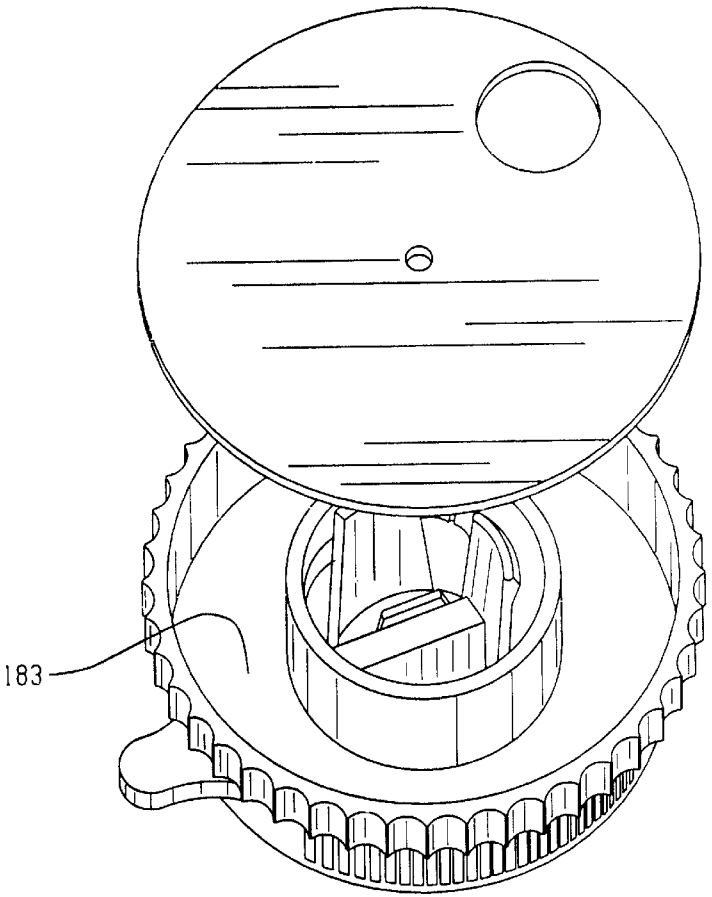
FIG. 8 illustrates another alternate base of a product dispenser according to the within invention.
Figure 7C:
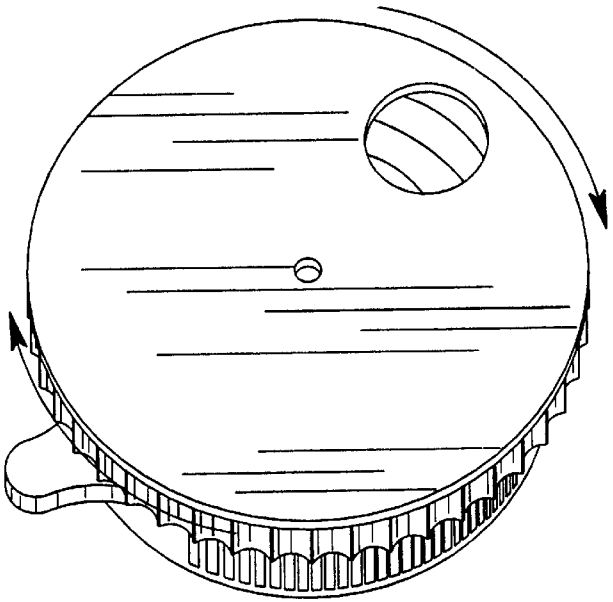

The underside of the base 16 optionally comprises a series of support ribs 182. In an alternate embodiment, the ribs define one or more storage compartments 183 for spent product. Where individual compartments are defined by such ribs, spent product can be secured in position using an interference fit between the product and the storage compartment. Alternatively, spent product can be secured into position by sealing the compartments with a rotatable covering 184 having an opening 185, as illustrated in FIGS. 7*a–c*. The opening 185 could be aligned with an individual storage compartment to allow the spent air cells to pass through the opening into the compartment 183. In the event support ribs are not utilized, the void volume of the base can still function as a repository for spent product as illustrated in FIG. 8.

To operate the dispenser from the starting position, the push element 14 is placed in the first position, the fully retracted position. The cover 12 and base 16 are then rotated with respect to each other until a stop position is reached where product is located in the product dispensing position. The push element is then advanced to the fully extended position, causing the product to transition from the product dispensing position to the landing. At this point, the dispenser 10 may be used as a handle to orient the product and insert it correctly into a device.

The invention claimed is:

1. A dispenser for transporting, housing and dispensing product, said dispenser comprising:

a cover comprising a roof and an opening in said roof;

a push element slidably engaged along the roof opening;

a base; and a landing for removably retaining product, wherein said cover and said base are rotatable with respect to each other about a common axis.

2. The dispenser of claim 1, wherein the push element has a first position in which said element is fully retracted and a second position in which said element is partially or fully extended.

3. The dispenser of claim 2, wherein said cover further comprises at least one frictional engagement structure contacting the push element when said element is in the second position.

4. The dispenser of claim 3, wherein said at least one frictional engagement structure contacts the push element during the first position of said element.

5. The dispenser of claim 2, wherein said cover and base are only rotatable with respect to each other when said push element is in the first position.

6. The dispenser of claim 1, wherein said landing is inclined from the plane of the base.

7. The dispenser of claim 1, wherein said landing further comprises a magnet.

8. The dispenser of claim 7, wherein said magnet is exposed.

9. The dispenser of claim 7, wherein said magnet is embedded within said landing.

10. The dispenser of claim 8, wherein said magnet comprises a planar surface.

11. The dispenser of claim 1, wherein said base further comprises an adhesive platform.

12. The dispenser of claim 11, wherein said platform comprises a plurality of adhesive layers.

13. The dispenser of claim 12, wherein said outermost adhesive layer is covered with an overcoat layer with one or more cutouts exposing the underlying adhesive.

14. The dispenser of claim 11, further comprising one or more products secured to the platform.

15. The dispenser of claim 12, further comprising one or more products secured to the platform.

16. The dispenser of claim 13, further comprising one or more products secured to the platform.

17. The dispenser of claim 1, further comprising one or more products secured to the base with an adhesive applied to discrete locations of the base.

18. The dispenser of claim 1 wherein said cover can be removably connected with said base.

19. The dispenser of claim 18, said cover further comprising at least one snap hook connector.

20. The dispenser of claim 19, said snap hook connector further comprising a rib.

21. The dispenser of claim 20, the base further comprising a ridge and spaced turrets, said turrets further comprising grooves.

22. The dispenser of claim 21, wherein upon connection of said cover and said base, said snap hook connector engages said ridge and said snap hook connector rib engages said turret groove.

23. The dispenser of claim 22, said push element further comprising a rudder that prevents rotation of said base with respect to said cover when said rudder occupies the space between said turret.

24. The dispenser of claim 1, wherein said landing is integral with said cover.

25. The dispenser of claim 1, wherein said landing is integral with said base.

26. The dispenser of claim 1, wherein said base further comprises at least one storage compartment.

27. The dispenser of claim 26, wherein said base further comprises a cover over said storage compartment.

28. The dispenser of claim 27, wherein said storage compartment cover is rotatable with respect to said base and further comprises at least one opening.

29. The dispenser of claim 27, wherein said cover comprises at least one opening.

30. The dispenser of claim 1, wherein said cover further comprises a rib along at least a portion of the inner surface of said cover.

31. The dispenser of claim 30, said base further comprising a gasket layer secured on one side to said base.

* * * * *